United States Patent [19]

Lafer

[11] 4,141,590

[45] Feb. 27, 1979

[54] COLLAPSIBLE FURNITURE STRUCTURE

[76] Inventor: Percival Lafer, Rau Lavapes No. 22 CEP01519, Sao Paulo, Brazil

[21] Appl. No.: 863,620

[22] Filed: Dec. 23, 1977

[30] Foreign Application Priority Data

Jan. 17, 1977 [BR] Brazil ..... 7700317

[51] Int. Cl.[2] ..... A47C 1/12; A47C 7/02

[52] U.S. Cl. ..... 297/440; 297/441; 297/456

[58] Field of Search ..... 297/441, 440, 45, 443, 297/456, 445, 455; D6/65, 47; 248/188.7

[56] References Cited

U.S. PATENT DOCUMENTS

| | | | |
|---|---|---|---|
| 2,673,596 | 3/1954 | Von Haase | 297/440 X |
| 3,885,766 | 5/1975 | Resch et al. | 297/232 |
| 4,049,314 | 9/1977 | McGaffin | 297/441 X |

FOREIGN PATENT DOCUMENTS

| | | | |
|---|---|---|---|
| 782495 | 1/1964 | Canada | 248/188.7 |
| 966410 | 4/1975 | Canada | 297/441 |
| 2524907 | 12/1976 | Fed. Rep. of Germany | 248/188.7 |
| 58756 | 11/1953 | France | 297/441 |
| 1288461 | 9/1972 | United Kingdom | 297/441 |

*Primary Examiner*—James T. McCall
*Attorney, Agent, or Firm*—Cesari and McKenna

[57] ABSTRACT

A collapsible furniture structure comprises a pair of free standing vertical support elements and a pair of rigid, U-shaped frame elements. Orifices are formed in the upper portions of the vertical support elements in which the extremities of the U-shaped frame elements are inserted and supported. The orifices are oriented and located so that, in the case of a chair, one of the frame elements extends forwardly from the support elements to define a seat portion of the chair while the other of the frame elements extends upwardly from the support elements to define a back rest portion of the chair. A cushion may be placed over the mounted frame elements for added comfort. Additional orifices may be formed in the lower portion of the vertical support elements into which additional floor engaging frame elements are inserted to provide a wider base to the structure. All frame elements are readily removable from the orifices to disassemble the structure for moving or storage.

10 Claims, 4 Drawing Figures

COLLAPSIBLE FURNITURE STRUCTURE

BACKGROUND OF THE INVENTION

This invention relates generally to modular, collapsible structures and, more particularly, to modular, collapsible, fastener-less, furniture structures.

Generally, structures consist of various rigid elements combined together for the purpose of resisting the action of forces applied thereto, preferably with little or no deformation of the elements arising. The design and dimensions of structures are made in each case according to the function for which they are intended and the type of load they will have to bear. Structural researchers are constantly striving to improve and perfect structural designs in terms of esthetics and mechanical efficiency. Improvements in mechanical efficiency involve improvements not only in the ability of the structures to serve their intended load bearing functions but also those in terms of the cost of manufacturing, using and maintaining the structures.

These same considerations are important in all fields involving structures, whether in architecture, in the building of vehicles, or in the construction of furniture and similar objects, which are the subject matter of the present invention. As is known, most furniture structures are assembled at the factory and not intended to be readily disassembled by the user. This fact makes the handling and transportation of the structures a problem, particularly if the structure is relatively heavy, bulky and awkward. For the manufacturer, the problem translates into one of increased costs for warehousing, handling and delivery of the furniture. For the user, the problem is primarily one of inconvenience as it is difficult to move the furniture about and can also involve increased costs of the user is required to retain professional assistance to have the furniture moved to a distant location.

Because of this problem, collapsible furniture structures are becoming more and more popular. With a collapsible structure, the manufacturer is generally able to store and ship the furniture in a disassembled, relatively compact form and thus reduce its warehousing and transportation costs. The user is also generally able to disassemble the structures with relative ease when the structures are to be moved or temporarily stored. Many collapsible structures, however, while more convenient to store and handle, are more expensive to manufacture. This is because of need for providing fastening or connecting mechanisms such as dovetail joints, screws, bolts, nails, dowel pins or the like. Many collapsible structures are also such that specially designed reinforcement parts must also be provided and these additional parts further add to the costs of the structures.

The broad object of the present invention is to provide a unique furniture structure that is readily collapsible and thus convenient to store, transport and handle and that is also relatively simple and inexpensive to produce in that it eliminates the need for traditional fastening and connecting mechanisms.

SUMMARY OF THE INVENTION

A furniture structure embodied in accordance with the invention comprises at least one pair of upstanding support elements. The support elements preferably have the form of a relatively thick plate or block and are preferably integrally fabricated from wood, metal or another appropriate material. Each support element is provided with at least one pair of angularly displaced interfitting means such as sockets or orifices. In the case of a chair, which is the particular structure illustratively described in detail hereinbelow, connecting the orifices are formed near the top and front side of the vertical support elements and are angularly displaced relative to one another by about 90 degrees. The extremities of two, relatively rigid U-shaped elements are adapted to fit, with application of slight pressure, into corresponding orifices in the vertical support elements. One of the two U-shaped elements thus defines a back rest portion of the chair while the other of the two U-shaped elements defines a seat portion of the chair. A cushion may be removably secured to the joined ends of the U-shaped elements to provide added comfort to the chair.

To provide added stability to structure, an additional pair of orifices may be provided in opposite sides of the vertical support elements near the lower, or floor engaging end thereof. Relatively rigid, straight rods may then be fitted into these orifices to provide a wider, more stable base support to the structure.

BRIEF DESCRIPTION OF THE DRAWING

The foregoing and other features and advantages of the invention will be better understood from the following detailed description taken in conjunction with the accompanying drawing in which.

DETAILED DESCRIPTION OF ILLUSTRATIVE EMBODIMENT

Figure 1:
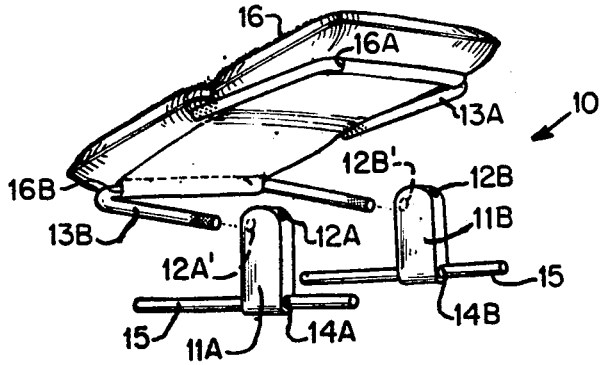
FIG. 1 shows a lower perspective view of a furniture structure embodying the invention, in the form of a chair, with its respective parts disassembled.

Referring now specifically to the drawing, there is shown generally at 10 a furniture structure embodying the invention illustratively in the form of a chair. The structure 10 comprises an identical pair of vertical support elements 11A and 11B. The elements 11A and 11B are each illustratively in the form of an elongated block, of considerable thickness, the upper end of which is rounded somewhat and the lower, or floor engaging end of which is left rectilinear to provide good contact with the floor.

Each support element 11A and 11B has formed therein a pair of sockets or orifices 12A and 12A' and 12B and 12B', respectively. The orifices 12A and 12B are formed in the upper rounded ends of their respective elements 11A and 11B and are displaced or inclined somewhat from a vertical position toward the rear of the structure 10. The orifices 12A' and 12B' are formed in the upper, front side of the respective elements 11A and 11B and are also displaced or inclined slightly upward from a horizontal position. The orifices in each pair 12A–12A' and 12B–12B' are preferably in the same vertical plane but are angularly displaced from one another by about 90 degrees.

Figure 2:
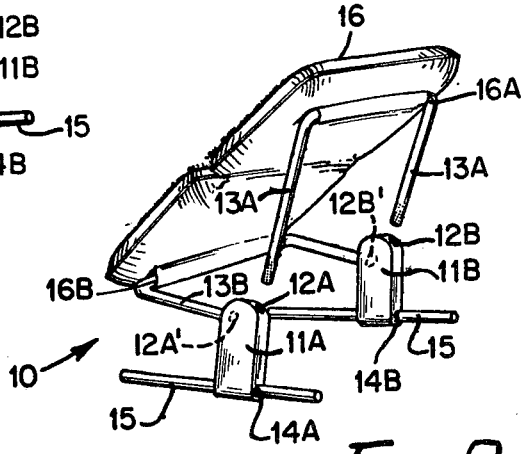
FIG. 2 shows a lower perspective view of the structure of FIG. 1 with its parts partially assembled.
Figure 3:
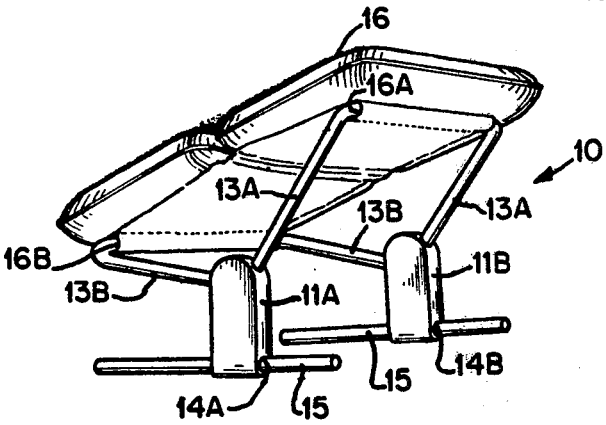
FIG. 3 shows a lower perspective view of the structure of FIG. 1 with its parts completely assembled.
Figure 4:
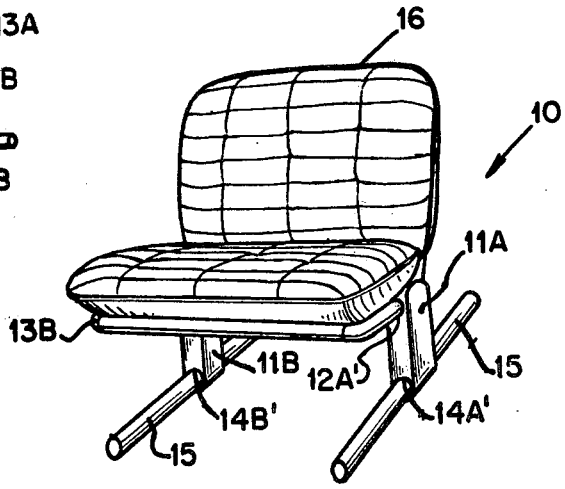
FIG. 4 shows an upper perspective view of the assembled structure of FIG. 1.

Two, generally U-shaped, relatively rigid frame elements 13A and 13B are also provided. The extremities of the U-shaped frame elements 13A and 13B are adapted to fit and be retained within the orifices 12A, 12A', 12B and 12B' in the support elements 11A and 11B, respectively. More specifically, as indicated in FIG. 2, the extremities of the frame element 13B fit within the forward looking orifices 12A' and 12B'. As shown in FIG. 3, the extremities of the frame element 13A fit within the upward looking orifices 12A and 12B. The element 13A thus defines a back rest portion of the chair while the element 13B defines a seat portion of the chair.

Each of the orifices 12A, 12A', 12B and 12B' is preferably of sufficient depth so that a considerable length of the extremities of the frame elements 13A and 13B may be received therein to provide strong, stable support for the elements 13A and 13B. The relative dimensions of the orifices and extremities of the elements 13A and 13B are also selected such that a slight force must be applied to the elements in order to force them into the orifices and a similar, but oppositely directed force must be applied to remove them. As indicated in the drawing, the extremities of the frame element 13A and 13B may be roughened to improve their retention in the orifices. Other well known releasable retaining techniques, such as snap fitting or the like, may be used for this purpose if desired.

To provide added base stability to the structure 10, another pair of counter-extending orifices 14A–14A' and 14B–14B' is provided just above the floor at the lower, floor engaging end of each support element 11A and 11B. Relatively rigid, straight rods 15 may then be removably fitted within these additional orifices to lengthen in the forward and rearward directions the floor engaging portions of the structure 10.

A seat cushion 16 rests on the frame elements 13A and 13B to provide added comfort to the chair. The cushion 16 is preferably foldable at an intermediate position as indicated so that it matches the contour of the two frame elements 13A and 13B in their supported position. The cushion 16 may also be removably secured to the joined ends of the elements 13A and 13B, as by passing those ends through pockets 16A and 16B formed in the underside of the cushion 16.

The support elements 11A and 11B are preferably integrally formed from wood, metal or like material. The elements 11A and 11B may also be formed from metal tubing that is bent into a suitable support providing shape. In the latter case, the interior hollow space of the metal tubing may be used to define the various orifices 12 and the rods 15 may be an integral part of the support elements 11A and 11B. The frame elements 13A and 13B may also be formed from rigid metal tubing.

The resulting assembled structure 10 is both stable and durable in use because the frame elements 13A and 13B are both rigid by themselves and securely anchored within the orifices of the support elements 11A and 11B. Each of the elements 13A and 13B strongly resists bending and deformation under load and contributes to the strength and firmness of the assembled structure 10.

It will be appreciated that the structure 10 is relatively inexpensive to produce because of the constructive simplicity of its component parts and because of the lack of any special fastening or connecting parts such as screws, bolts or the like. The structure 10 is also very simple to assemble and disassemble and, when disassembled, can be arranged in a relatively small, compact package for moving or storage. It should be understood that while a structure 10 in the form of a chair has been described, other collapsible furniture structures can readily be made using the above described elements or minor modifications thereof. For example, table, bed and bench structures can be formed using the U-shaped frame elements 13A and 13B together with support elements like the elements 11A and 11B, but having orifices that are oriented and located to enable the elements 13A and 13B to be supported in a common, horizontal plane. In the case of a table structure, the cushion 16 may be replaced by a relatively flat, rigid table top. Other furniture structures can also be constructed.

Additionally, in some cases, it may be desirable to use more than two support elements and/or more than two U-shaped frame elements in a given structure depending upon the particular design that is to be achieved.

It may also be desirable to provide cross members, such as straight rods, that span and interconnect the separate support elements. The cross members may also be supported in additional orifices formed in the support elements.

It should also be understood that while orifices have been shown and described as the connecting means for mounting the frame elements 13A and 13B relative to the support elements 11A and 11B, other suitable connecting means may be used. For example, the orifices 12 and 14 may be replaced by protruding pins that fit within the interior hollow spaces formed in the extremities of the frame elements 13A and 13B.

It is thus the object of the appended claims to cover these and other modifications as come within the true spirit and scope of the invention.

What I claim as new and desire to secure by Letters Patent of the United States is:

1. A collapsible structure adapted for use as an item of furniture comprising:

A. a pair of relatively thick, upstanding support blocks, each of which includes
   i. an upper end portion
   ii. a lower end portion adapted to rest upon a suporting surface, and
   iii. connecting means formed at at least two separate locations in the upper end portion of each said support block, said connecting means being angularly displaced from one another;

B. at least two frame elements, each of which
   i. is substantially U-shaped including two spaced apart extremities, and
   ii. is formed of a rigid material that resists bending and deformation under load;

C. the spaced apart extremities of said frame elements being removably securable by said connecting means to said support blocks so that said frame elements are supported from said support blocks in extending positions angularly displaced from one another.

2. The structure of claim 1 in which said connecting means comprise means defining first and second orifices formed in angularly displaced locations in the upper end portion of each said support block for removably receiving and retaining the spaced apart extremities of said frame elements.

3. The structure of claim 2 adapted for use as a chair and in which one of said two orifices in the upper end portion of each said support block is formed in a generally forward looking position and the other of said two orifices is formed in a generally upwardly looking position angularly displaced from said forwardly looking orifice by about 90 degrees or more, the extremities of one of said frame elements are supported within said forwardly looking orifices in said support elements to define a seat portion of the chair, and the extremities of the other of said frame elements are supported within said upwardly looking orifices in said support elements to define a back rest portion of the chair.

4. The structure of claim 3 further including

D. a cushion adapted to span and cover said two frame elements in their supported positions to add comfort to the seat and back rest portions of the chair.

5. The structure of claim 4 in which said cushion is foldable at an intermediate position so as to match the contour of said two frame elements in their supported positions.

6. The structure of claim 4 in which said cushion includes means for removably securing said cushion to said frame elements.

7. The structure of claim 1 in which each of said support blocks further includes iv. at least one additional connecting means formed in the lower end portion thereof, and in which said structure further includes D. at least two additional frame elements each including an extremity that is removably securable by said additional connecting means to the lower end portion of said support elements, said additional frame elements laterally extending from the lower end portion of said support blocks to provide added base stability to said structure.

8. The structure of claim 7 in which said additional connecting means comprise means defining additional orifices in the lower end portion of each said support block for removably receiving and retaining extremities of said additional frame elements.

9. The structure of claim 7 in which said additional frame elements comprise straight rods.

10. The structure of claim 1 in which said frame elements are formed from rigid metal tubing.

* * * * *